US010976690B1

(12) United States Patent
Furukawa et al.

(10) Patent No.: US 10,976,690 B1
(45) Date of Patent: Apr. 13, 2021

(54) TRANSFER DEVICE AND IMAGE FORMING APPARATUS

(71) Applicant: FUJI XEROX CO., LTD., Tokyo (JP)

(72) Inventors: Masato Furukawa, Kanagawa (JP); Shigeru Fukuda, Kanagawa (JP); Futoshi Takei, Kanagawa (JP); Satoya Sugiura, Kanagawa (JP); Daisuke Tanemura, Kanagawa (JP); Masato Ono, Kanagawa (JP); Hiroaki Tanaka, Kanagawa (JP); Shogo Hayashi, Kanagawa (JP); Minoru Rokutan, Kanagawa (JP); Tomoko Suzuki, Kanagawa (JP); Masayuki Seko, Kanagawa (JP); Koichi Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/853,832

(22) Filed: Apr. 21, 2020

(30) Foreign Application Priority Data

Dec. 6, 2019 (JP) ..... 2019-221326

(51) Int. Cl.
*G03G 15/00* (2006.01)
*G03G 15/16* (2006.01)

(52) U.S. Cl.
CPC ..... *G03G 15/162* (2013.01); *G03G 15/161* (2013.01)

(58) Field of Classification Search
None
See application file for complete search history.

(56) References Cited

U.S. PATENT DOCUMENTS 9,733,596 B1 * 8/2017 Furukawa ..... G03G 15/162

FOREIGN PATENT DOCUMENTS

JP 2007-11117 A 1/2007
JP 2017-181604 A 10/2017

* cited by examiner

*Primary Examiner* — Jas A Sanghera
(74) *Attorney, Agent, or Firm* — Sughrue Mion, PLLC

(57) ABSTRACT

Provided is a transfer device that includes an intermediate transfer body which is a first endless belt including a resin and conductive carbon particles and in which in a spatial distribution of the conductive carbon particles that are present in an evaluation region of 6.3 μm×4.2 μm on an outer peripheral surface; a first transfer component that first-transfers a toner image formed on a surface of an image carrier to a surface of the intermediate transfer body; and a second transfer component which has a second endless belt disposed so as to face the outer peripheral surface of the intermediate transfer body, which second-transfers the toner image transferred to the surface of the intermediate transfer body to a surface of a recording medium on the second endless belt.

20 Claims, 2 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2019-221326 filed December 2019.

BACKGROUND

(i) Technical Field

The present disclosure relates to a transfer device and an image forming apparatus.

(ii) Related Art

In electrophotographic image forming apparatuses (such as a copying machine, a facsimile, and a printer), an image is formed by transferring a toner image formed on a surface of an image carrier to a surface of a recording medium and fixing the toner image to the recording medium. When such a toner image is transferred to a recording medium, a conductive endless belt, such as an intermediate transfer belt, is used.

For example, Japanese Unexamined Patent Application Publication No, 2017-181604 discloses "a conductive member for an image forming apparatus, the conductive member including a conductive layer which has a matrix containing a conductive organic polymer material, and domains formed by aggregates of an electronically conductive conductivity-imparting agent and having particle sizes of 100 nm or more and 3 μm or less, and in which the number of domains in a 10 μm×10 μm square is 20 or more and 50 or less".

Japanese Unexamined Patent Application Publication. No. 2007-011117 discloses "an intermediate transfer belt having at least a surface layer on a base, in which the surface layer contains aggregates of conductive particles, the aggregates having an average particle size of 0.5 to 25 μm".

SUMMARY

In a transfer device in which a toner transferred to a surface of an intermediate transfer body which is a first endless belt is transferred to a recording medium by using a second transfer component having a second transfer member which is a second endless belt, the use of an endless belt that includes a conductive layer containing an ionically conductive organic polymer material and an electronically conductive conductivity-imparting agent as the second endless belt may cause an increase in the resistance due to a repeated application of a high voltage during continuous use. An example of a method for suppressing this increase in the resistance includes adjusting the number of domains formed by aggregates of the electronically conductive conductivity-imparting agent and having particle sizes of 100 nm or more and 3 μm or less to 20 or more and 50 or less in a 10 μm×10 μm square, and adjusting the common logarithm of the volume resistivity of the entire second endless belt to 10.0 Log Ω·cm or more and 12.5 Log Ω·cm or less.

Regarding the second endless belt in which the number of domains and the common logarithm of the volume resistivity are adjusted to the above ranges, the increase in the resistance is suppressed. However, for example, when sheets of cardboard having a basis weight of more than 300 g/m$^2$ are continuously fed, discharge marks due to abnormal discharge at an edge of a sheet may be generated on the surface of the endless belt which is the second transfer member.

Aspects of non-limiting embodiments of the present disclosure relate to a transfer device in which the generation of discharge marks in the second endless belt is suppressed compared with the case where the number of the domains in the second endless belt is 20 or more and 50 or less, the common logarithm of the volume resistivity of the entire second endless belt is 10.0 Log Ω·cm or more and 12.5 Log Ω·cm or less, and an integrated value of a statistic L(r) in the first endless belt is more than 0.1.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer device including an intermediate transfer body which is a first endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less; a first transfer component that first-transfers a toner image formed on a surface of an image carrier to a surface of the intermediate transfer body; and a second transfer component which has a second endless belt disposed so as to face the outer peripheral surface of the intermediate transfer body, which second-transfers the toner image transferred to the surface of the intermediate transfer body to a surface of a recording medium on the second endless belt, and in which the second endless belt includes a conductive layer that has a matrix containing an ionically conductive organic polymer material and domains formed by aggregates of an electronically conductive conductivity-imparting agent and having particle sizes of 100 nm or more and 3 μm or less, a number of the domains in a 10 μm×10 μm square of the conductive layer is 20 or more and 50 or less, and a common logarithm of a volume resistivity of the entire second endless belt is 10.0 Log Ω·cm or more and 12.5 Log Ω·cm or less.

$$L(r):=\sqrt{K(r)/\pi}-r \tag{1}$$

In the formula (1), r represents the interparticle distance, and K(r) represents a Ripley's K function K(r) represented by a formula (2) below.

$$K(r):=\frac{\sum_{i\neq j}^{N} 1(|X_i-X_j|\leq r)/s(|X_i-X_j|)}{\lambda^2} \tag{2}$$

In the formula (2), $1(|X_i-X_j|\leq r)$ represents an indicator function; $X_i$ and $X_j$ represent coordinates of a point i and a point j, respectively; $|X_i-X_j|$ represents a Euclidean distance between the coordinates $X_i$ and the coordinates $X_j$; r represents the interparticle distance; $s(|X_i-X_j|)$ represents an edge correction factor s(x) in the evaluation region, the edge correction factor s(x) being represented by a formula (3) below, where $x=|X_i-X_j|$; N represents a total number of particles in the evaluation region; and λ represents a number density of particles in the evaluation region.

$$s(x) := L_x L_y - \frac{x}{\pi}(2L_x + 2L_y - x) \tag{3}$$

In the formula (3), $L_x$ and $L_y$ represent a length (μm) of a side of the evaluation region in an x-axis direction and a length (μm) of a side of the evaluation region in a y-axis direction, respectively; $x=|X_i-X_j|$; $X_i$ and $X_j$ represent coordinates of the point i and the point j, respectively; and $|X_i-X_j|$ represents the Euclidean distance between the coordinates $X_i$ and the coordinates $X_j$.

BRIEF DESCRIPTION OF THE DRAWINGS

Exemplary embodiments of the present disclosure will be described in detail based on the following figures, wherein.

DETAILED DESCRIPTION

Figure 1A:
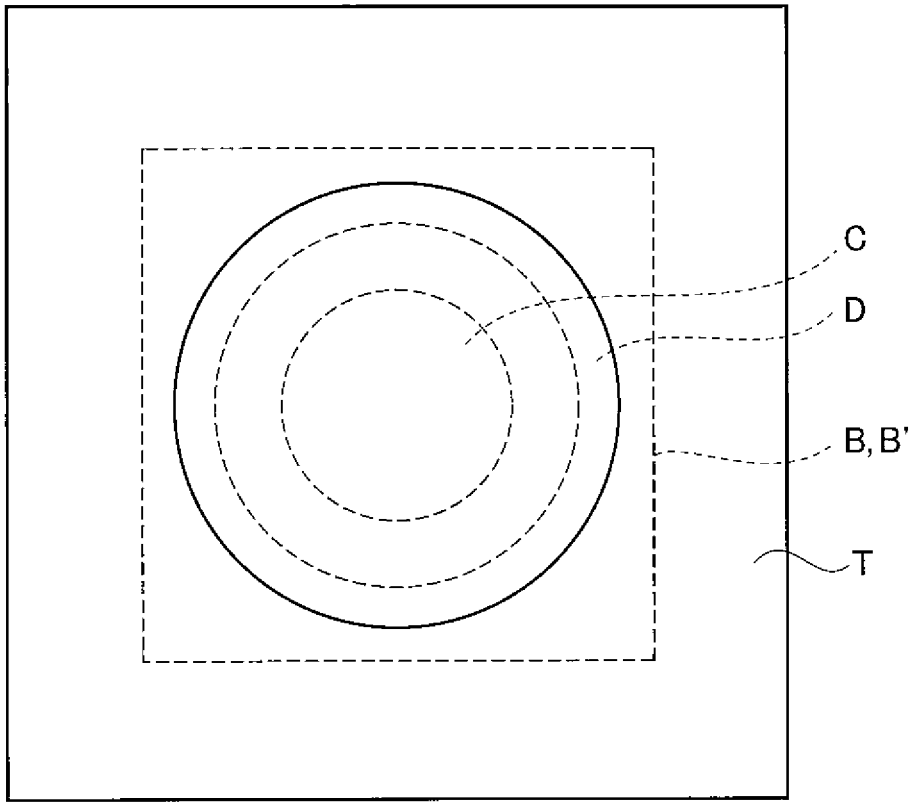
FIGS. 1A and 1B are a schematic plan view and a schematic sectional view, respectively, of an example of a circular electrode.

Exemplary embodiments will be described below. The following description and Examples are illustrative of the exemplary embodiments and are not intended to limit the scope of the exemplary embodiments.

In numerical ranges described in a stepwise manner in the exemplary embodiments, the upper limit value or the lower limit value of a numerical range may be replaced with the upper limit value or the lower limit value of another numerical range described in a stepwise manner. In a numerical range described in the exemplary embodiments, the upper limit value or the lower limit value of the numerical range may be replaced with the upper limit value or the lower limit value described in Examples below.

In the exemplary embodiments, the term "step" refers not only to an independent step but also to a step that is not clearly distinguishable from other steps as long as an intended purpose of the step is achieved.

In the exemplary embodiments, when an exemplary embodiment is described with reference to a drawing, the configuration of the exemplary embodiment is not limited to the configuration illustrated in the drawing. The sizes of members illustrated in the drawing are conceptual, and the relative relations between the sizes of the members are not limited to these relations.

In the exemplary embodiments, any component may include plural types of substances corresponding to the component. In the exemplary embodiments, when plural types of substances corresponding to a component are present in a composition, the amount of the component in the composition means the total amount of the plural types of substances that are present in the composition, unless otherwise specified.

Transfer Device

A transfer device according to an exemplary embodiment includes an intermediate transfer body which is a first endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less; a first transfer component that first-transfers a toner image formed on a surface of an image carrier to a surface of the intermediate transfer body; and a second transfer component which has a second endless belt disposed so as to face the outer peripheral surface of the intermediate transfer body, which second-transfers the toner image transferred to the surface of the intermediate transfer body to a surface of a recording medium on the second endless belt, and in which the second endless belt includes a conductive layer that has a matrix containing an ionically conductive organic polymer material and domains formed by aggregates of an electronically conductive conductivity-imparting agent and having particle sizes of 100 nm or more and 3 μm or less, a number of the domains in a 10 μm×10 μm square of the conductive layer is 20 or more and 50 or less, and a common logarithm of a volume resistivity of the entire second endless belt is 10.0 Log Ω·cm or more and 12.5 Log Ω·cm or less.

$$L(r) := \sqrt{K(r)/\pi} - r \tag{1}$$

In the formula (1), r represents the interparticle distance, and K(r) represents a Ripley's K function K(r) represented by a formula (2) below.

$$K(r) := \frac{\sum_{i \neq j}^{N} 1(|X_i - X_j| \leq r)/s(|X_i - X_j|)}{\lambda^2} \tag{2}$$

In the formula (2), $1(|X_i-X_k|\leq r)$ represents an indicator function; $X_i$ and $X_j$ represent coordinates of a point i and a point j, respectively; $|X_i-X_j|$ represents a Euclidean distance between the coordinates $X_i$ and the coordinates $X_j$; r represents the interparticle distance; $s(|X_i-X_j|)$ represents an edge correction factor s(x) in the evaluation region, the edge correction factor s(x) being represented by a formula (3) below, where $x=|X_i-X_j|$; N represents a total number of particles in the evaluation region; and λ represents a number density of particles in the evaluation region.

$$s(x) := L_x L_y - \frac{x}{\pi}(2L_x + 2L_y - x) \tag{3}$$

In the formula (3), $L_x$ and $L_y$ represent a length (μm) of a side of the evaluation region in an x-axis direction and a length (μm) of a side of the evaluation region in a y-axis direction, respectively; $x=\equiv X_i-X_j|$; $X_i$ and $X_j$ represent coordinates of the point i and the point j, respectively; and $|X_i-X_j|$ represents the Euclidean distance between the coordinates $X_i$ and the coordinates $X_j$.

Hereinafter, in the spatial distribution of the conductive carbon particles that are present in the evaluation region of 6.3 μm×4.2 μm on the outer peripheral surface of the first endless belt, the integrated value of the statistic L(r) represented by the formula (1) in an interparticle distance r of 0.05 μm or more and 0.30 μm or less is also referred to as an "L(r) integrated value".

Domains formed by aggregates of the electronically conductive conductivity-imparting agent and having particle sizes of 100 nm or more and 3 μm or less are also referred to as "specific domains", and the number of specific domains in a 10 μm×10 μm square of the conductive layer is also referred to as the "number of domains".

Herein, the spatial distribution of the conductive carbon particles is obtained by observing the outer peripheral surface of the first endless belt with a scanning electron microscope (for example, model number: SU8010 available from Hitachi High-Tech Corporation) at a magnification of 20,000, and binarizing the obtained 256 gradation image at a threshold of 128 by using analysis software (for example, free software "ImageJ") as required. Subsequently, the statistic L(r) in the interparticle distance r of 0.05 μm or more and 0.30 μm or less is calculated for every 0.05 μm on the basis of the above formulae to determine the integrated value in the range of 0.05 μm or more and 0.30 μm or less.

The particle sizes of domains formed by aggregates of the conductivity-imparting agent mean the maximum sizes of the domains. The sizes of the domains and the number of domains are measured by observing a cross section of the second endless belt. The specific method is as follows.

The second endless belt is cut by using a single-edged razor in the thickness direction to form a cross section. The cross section of the conductive layer in the second endless belt is observed with a scanning electron microscope (SEM). Areas having a low contrast in the cross-sectional observation are determined to be domains, and the maximum particle size of each domain in one field of view is measured.

The number of domains in a 10 μm×10 μm square is calculated from the measurement results of the sizes of the domains.

In the exemplary embodiment, since the integrated value of the statistic L(r) in the first endless belt is 0 or more and 0.1 or less, the number of domains in the second endless belt is 20 or more and 50 or less, and the common logarithm of the volume resistivity of the entire second endless belt is 10.0 Log Ω·cm or more and 12.5 Log Ω·cm or less, the generation of discharge marks in the second endless belt is suppressed compared with the case where the number of domains in the second endless belt is 20 or more and 50 or less, the common logarithm of the volume resistivity of the entire second endless belt is 10.0 Log Ω·cm or more and 12.5 Log Ω·cm or less, and the integrated value of the statistic L(r) in the first endless belt is more than 0.1. The reason for this is not clear, but is assumed as follows.

In a transfer device in which an endless belt is used as a second transfer member, the use of an endless belt that includes a conductive layer containing an ionically conductive organic polymer material and an electronically conductive conductivity-imparting agent as the endless belt may cause an increase in the resistance due to a repeated application of a high voltage during continuous use. The increase in the resistance is considered to be caused by uneven distribution of ions in the conductive layer and oxidative degradation of the ionically conductive organic polymer material.

An example of a method for suppressing this increase in the resistance includes adjusting the number of domains formed by aggregates of the electronically conductive conductivity-imparting agent and having particle sizes of 100 nm or more and 3 μm or less to 20 or more and 50 or less in a 10 μm×10 μm square, and adjusting the common logarithm of the volume resistivity of the entire endless belt to 10.0 Log Ω·cm or more and 12.5 Log Ω·cm or less.

Regarding the endless belt in which the number of domains and the common logarithm of the volume resistivity are adjusted to the above ranges, the increase in the resistance is suppressed. However, when sheets of cardboard having a basis weight of more than 300 g/m$^2$ are continuously fed, discharge marks due to abnormal discharge at an edge of a sheet may be formed on the surface of the endless belt which is the second transfer member. In particular, with the recent increase in the speed of an image forming apparatus and realization of high image quality, a high voltage (for example, 2.0 kV or more) may be applied to a second transfer region, and thus presumably, abnormal discharge tends to occur in a discharge gap at an edge of cardboard. Furthermore, in a low-temperature, low-humidity environment, since the electrical resistance is increased by the temperature-humidity dependence of the endless belt, the voltage applied to the second transfer region is increased. Accordingly, during continuous feeding of sheets of cardboard, the generation of discharge marks tends to occur considerably. When an image is further formed after the generation of the discharge marks on the outer peripheral surface of the endless belt which is the second transfer member, the discharge marks may affect a second transfer step, resulting in the formation of an image with print defects of the image density, the defects being due to the discharge marks.

In contrast to this, in the exemplary embodiment, the L(r) integrated value in the first endless belt is 0 or more and 0.1 or less. That is, conductive carbon particles are finely dispersed on the outer peripheral surface of the first endless belt. Therefore, even if a high voltage is applied to a discharge gap at an edge of cardboard, small discharge occurs in each of conductive points that are finely dispersed on the outer peripheral surface of the first endless belt, and a current is distributed to the dispersed points. It is assumed that abnormal discharge is consequently suppressed, and discharge marks due to abnormal discharge are unlikely to be generated.

As used herein, the term "conductive" means that a volume resistivity at 20° C. is less than $1\times10^{13}$ Ωcm.

Hereafter, the first endless belt used as an intermediate transfer body and a second endless belt used as a second transfer member will be described.

First Endless Belt

The first endless belt includes a resin and conductive carbon particles, in which the integrated value of L(r) is 0 or more and 0.1 or less.

The first endless belt may be a single-layer product or a multilayer product.

When the first endless belt is a single-layer product, the single-layer product is a layer which includes a resin and conductive carbon particles and in which the integrated value of L(r) is 0 or more and 0.1 or less.

When the first endless belt is a multilayer product, the multilayer product has, for example, a base layer and a surface layer disposed on the base layer. The surface layer is the outermost layer of the first endless belt. The multilayer product may have another layer between the base layer and the surface layer.

When the first endless belt is a multilayer product having a base layer and a surface layer, the surface layer is a layer which includes a resin and conductive carbon particles and in which the integrated value of L (r) is 0 or more and 0.1 or less. The base layer is not particularly limited and may be, for example, a layer that includes a resin for a base layer and conductive carbon particles for a base layer.

Hereinafter, a layer of a first endless belt which is a single-layer product is also referred to as a "single layer". In a first endless belt which is a multilayer product, a surface layer that includes a resin and conductive carbon particles is also referred to as a "first layer", and a base layer that includes a resin for a base layer and conductive carbon particles for a base layer is also referred to as a "second layer". Furthermore, the resin and the conductive carbon particles that are included in the single layer or the first layer are also referred to as a "first resin" and "first conductive carbon particles", respectively. The resin for a base layer and the conductive carbon particles for a base layer, the resin and the conductive carbon particles being included in the second layer, are also referred to as a "second resin" and "second conductive carbon particles", respectively.

Resin

Examples of the first resin included in the single layer or the first layer include polyimide resins (PI resins), polyamide-imide resins (PAI resins), aromatic polyether ketone resins (e.g., aromatic polyether ether ketone resins), polyphenylene sulfide resins (PPS resins), polyetherimide resins (PEI resins), polyester resins, polyamide resins, and polycarbonate resins. From the viewpoints of mechanical strength and dispersibility of the first conductive carbon particles, the first resin preferably includes at least one selected from the group consisting of polyimide resins, polyamide-imide resins, aromatic polyether ketone resins, polyetherimide resins, and polyphenylene sulfide resins and more preferably includes at least one selected from the group consisting of polyimide resins and polyamide-imide resins. Of these, polyimide resins are still more preferable from the viewpoint of mechanical strength. The first resin may be formed from one resin or a mixture of two or more resins.

Specific examples and preferred examples of the second resin included in the second layer are also the same as the specific examples and the preferred examples of the first resin. The second resin may be formed from one resin or a mixture of two or more resins.

In the case where the first endless belt has the first layer and the second layer, the first resin and the second resin may be the same resin or different resins, and are preferably the same type of resin (for example, the first resin and the second resin are each preferably a polyimide resin).

Polyimide Resin

Examples of the polyimide resin include imidized products of polyamic acids (i.e., precursors of polyimide resins), which are polymerized products of a tetracarboxylic dianhydride and a diamine compound.

Examples of the polyimide resin include resins having a structural unit represented by a general formula (I) below.

General formula (I)

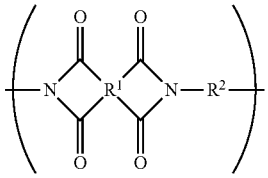

In the general formula (I), $R^1$ represents a tetravalent organic group and $R^2$ represents a divalent organic group.

Examples of the tetravalent organic group represented by $R^1$ include aromatic groups, aliphatic groups, alicyclic groups, groups that include an aromatic group and an aliphatic group in combination, and groups formed by substituting any of the above groups with a substituent. Specific examples of the tetravalent organic group include residues of tetracarboxylic dianhydrides described below.

Examples of the divalent organic group represented by $R^2$ include aromatic groups, aliphatic groups, alicyclic groups, groups that include an aromatic group and an aliphatic group in combination, and groups formed by substituting any of the above groups with a substituent. Specific examples of the divalent organic group include residues of diamine compounds described below.

Specific examples of the tetracarboxylic than hydride used as a raw material of a polyimide resin include pyromellitic dianhydride, 3,3',4,4'-benzophenonetetracarboxylic dianhydride 3,3',4,4'-biphenyltetraarboxylic dianhydride, 2,3,3',4-biphenyltetracarboxylic dianhydride, 2,3,6,7-naphthalenetetracarboxylic diahydride, 1,2,5,5-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, (3,4-dicarboxyphenyl)ether dianhydride, and ethylenetetracarboxylic dianhydride.

Specific examples of the diamine compound used as a raw material of a polyimide resin include 4,4'-diaminodiphenyl ether, 4,4'-diaminodiphenylmethane, 3,3'-diaminodiphenylmethane, 3,3'-dichlorobenzidine, 4,4'-diamaodiphen sulfide, 3,3'-diaminodiphenyl sulfone, 1,5-diaminonaphthalene, m-phenylenediamine, p-phenylenediamine, 3,3'-dimethyl-4,4'-biphenyl mine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-tert-butyl)toluene, bis(p-β-amino-tert-butylphenyl) ether, bis(p-β-methyl-δ-aminophenyl)benzene, bis-p(1,1-dimethyl-5-amino-pentyl) benzene, 1-isopropyl-2,4-m-phenylenediamine, m-xylylenediamine, p-xylylenediamine, di(p-aminocyclohexyl) methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

Polyamide-Imide Resin

Examples of the polyamide-imide resin include resins having a repeating unit including an imide bond and an amide bond.

Specific examples of the polyamide-imide resin include polymerized products of a trivalent carboxylic acid compound (also referred to as a tricarboxylic acid) having an acid anhydride group and a diisocyanate or diamine compound.

Examples of the tricarboxylic acid preferably include trimellitic anhydride and derivatives of trimellitic anhydride. The tricarboxylic acid may be used in combination with a tetracarboxylic dianhydride, an aliphatic dicarboxylic acid, an aromatic dicarboxylic acid, or the like.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have a structure similar to that of any of the above isocyanates and that have amino groups instead of isocyanato groups.

Aromatic Polyether Ketone Resin

Examples of the aromatic polyether ketone resin include resins in which aromatic rings such as benzene rings are linearly bonded to each other with an ether bond and a ketone bond therebetween.

Examples of the aromatic polyether ketone resin include polyether ketones (PEK) in which an ether bond and a ketone bond are alternately arranged, polyether ether ketones (PEEK) in which an ether bond, an ether bond, and a ketone bond are arranged in this order, polyether ketone ketones (PEKK) in which an ether bond, a ketone bond, and a ketone bond are arranged in this order, polyether ether ketone ketones (PEEKK) in which an ether bond, an ether bond, a ketone bond, and a ketone bond are arranged in this order, and polyether ketone esters including an ester bond.

The content of the first resin relative to the entire single layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

The content of the first resin relative to the entire first layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

The content of the second resin relative to the entire second layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

Conductive Carbon Particles

An example of the first conductive carbon particles included in the single layer or the first layer is carbon black.

Examples of the carbon black include Ketjenblack, oil-furnace black, channel black (i.e., gas black), and acetylene black. Carbon black that has been subjected to surface treatment (hereinafter, also referred to as "surface-treated carbon black") may also be used as the carbon black.

The surface-treated carbon black is produced by providing, for example, a carboxyl group, a quinone group, a lactone group, or a hydroxyl group to the surface of carbon black. Examples of the surface treatment method include an air oxidation method in which carbon black is brought into contact and allowed to react with air in a high-temperature atmosphere, a method in which carbon black is allowed to react with a nitrogen oxide or ozone at room temperature (e.g., 22° C.), and a method in which carbon black is oxidized with air in a high-temperature atmosphere and then oxidized by ozone at a low temperature.

From the viewpoint of adjusting the L(r) integrated value to the above range, the first conductive carbon particles are preferably channel black, more preferably surface-treated channel black among the conductive carbon particles mentioned above.

The first conductive carbon particles may be formed from one type of conductive carbon particles or a mixture of two or more types of conductive carbon particles.

Specific examples of the second conductive carbon particles included in the second layer also include conductive carbon particles similar to the specific examples of the first conductive carbon particles.

From the viewpoint of controlling conductivity, the second conductive carbon particles are preferably, among the conductive carbon particles mentioned above, channel black or furnace black, more preferably channel black or furnace black that is not subjected to surface treatment.

The second conductive carbon particles may be formed from one type of conductive carbon particles or a mixture of two or more types of conductive carbon particles.

The first conductive carbon particles have a number-average primary particle size, for example, in the range of 20 nm or less. From the viewpoint of adjusting the L(r) integrated value to the above range, the number-average primary particle size of the first conductive carbon particles is preferably in the range of 18 nm or less, more preferably in the range of 15 nm or less, still more preferably in the range of 13 nm or less. The first conductive carbon particles have a number-average primary particle size, for example, in the range of 2 nm or more.

From the viewpoint of adjusting the L(r) integrated value to the above range, the number-average primary particle size of the first conductive carbon particles is preferably in the range of 5 nm or more, more preferably in the range of 10 nm or more.

The second conductive carbon particles have a number-average primary particle size, for example, in the range of 2 nm or more and 40 nm or less. From the viewpoints of, for example, dispersibility, mechanical strength, and volume resistivity, the number-average primary particle size of the second conductive carbon particles is preferably in the range of 20 nm or more and 40 nm or less, more preferably in the range of 20 nm or more and 35 nm or less, still more preferably in the range of 20 nm or more and 28 nm or less.

In the case where the first endless belt has the first layer and the second layer, the number-average primary particle size of the first conductive carbon particles may be smaller than the number-average primary particle size of the second conductive carbon particles. The number-average primary particle size of the first conductive carbon particles is preferably 0.5 times or more and less than 1.0 time, more preferably 0.5 times or more and 0.8 times or less, still more preferably 0.5 times or more and 0.7 times or less the number-average primary particle size of the second conductive carbon particles.

In addition, the number-average primary particle size of the first conductive carbon particles is preferably 0.1 times or more and 1.0 time or less, more preferably 0.1 times or more and 0.8 times or less, still more preferably 0.2 times or more and 0.7 times or less the number-average primary particle size of the electronically conductive conductivity-imparting agent included in the second endless belt described below.

The number-average primary particle size of conductive carbon particles is measured by the following method.

First, a measurement sample having a thickness of 100 nm is taken from each layer of a prepared belt with a microtome. The measurement sample is observed with a transmission electron microscope (TEM). Subsequently, for each of 50 conductive carbon particles, the diameter of a circle having an area equal to the projected area (that is, equivalent circle diameter) is determined as a particle diameter of the conductive carbon particle. The average of the particle diameters of the 50 conductive carbon particles is defined as the number-average primary particle size.

The pH of the first conductive carbon particles is, for example, in the range of 1.0 or more and 5.5 or less, and preferably in the range of 1.0 or more and 3.0 or less from the viewpoint of adjusting the L(r) integrated value to the above range.

The pH of the second conductive carbon particles is, for example, in the range of 1.0 or more and 5.5 or less, and preferably in the range of 1.0 or more and 4.0 or less from the viewpoint of adjusting the L(r) integrated value to the above range.

In the case where the first endless belt has the first layer and the second layer, the pH of the first conductive carbon particles may be lower than the pH of the second conductive carbon particles.

The content of the first conductive carbon particles relative to the entire single layer is preferably 10% by mass or more and 50% by mass or less, more preferably 13% by mass or more and 30% by mass or less, still more preferably 15% by mass or more and 25% by mass or less from the viewpoint of reducing the L(r) integrated value and from the viewpoint of dispersibility, mechanical strength, and adjustment of the volume resistivity.

The content of the first conductive carbon particles relative to the entire first layer is preferably 10% by mass or more and 50% by mass or less, more preferably 13% by mass or more and 30% by mass or less, still more preferably 15% by mass or more and 25% by mass or less from the viewpoint of reducing the L(r) integrated value and from the viewpoint of dispersibility, mechanical strength, and adjustment of the volume resistivity.

The content of the second conductive carbon particles relative to the entire second layer is preferably 5% by mass or more and 40% by mass or less, more preferably 10% by mass or more and 30% by mass or less, still more preferably 20% by mass or more and 30% by mass or less from the viewpoint of dispersibility, mechanical strength, and adjustment of the volume resistivity.

Other Components

The single layer, the first layer, and the second layer may each include another component besides a resin and conductive carbon particles.

Examples of the other component include conductive agents other than the conductive carbon particles, fillers for improving strength of the belt, antioxidants for preventing the belt from being degraded by heat, surfactants for improving fluidity, and heat-resistant anti-aging agents.

In the case where the other component is included in any of the above layers, the content of the other component is preferably more than 0% by mass and 10% by mass or less, more preferably more than 0% by mass and 5% by mass or less, still more preferably more than 0% by mass and 1% by mass or less relative to the total mass of the layer including the other component.

Characteristics of First Endless Belt

L(r) Integrated Value of First Endless Belt

The L(r) integrated value of the first endless belt is 0 or more and 0.1 or less. From the viewpoint of further suppressing the generation of discharge marks in the second endless belt, the L(r) integrated value of the first endless belt is preferably 0 or more and 0.08 or less, more preferably 0 or more and 0.06 or less.

Examples of the method for adjusting the L(r) integrated value to the above range include, but are not particularly limited to, a method of using conductive carbon particles having a small number-average primary particle size as the first conductive carbon particles, a method of selecting the type of first conductive carbon particles used, and a method of adjusting conditions (e.g., drying conditions) in the process of producing the first endless belt.

Thickness of First Endless Belt

The thickness of the single layer is preferably 60 μm or more and 120 μm or less, more preferably 80 μm or more and 120 μm or less from the viewpoint of mechanical strength of the belt.

The thickness of the first layer is preferably 1 μm or more and 40 μm or less, more preferably 3 μm or more and 20 μm or less from the viewpoint of production suitability and from the viewpoint of suppressing discharge.

The thickness of the second layer is preferably 50 μm or more and 100 μm or less, more preferably 60 μm or more and 80 μm or less from the viewpoint of mechanical strength of the belt.

In the case where the first endless belt has the first layer and the second layer, the ratio of the thickness of the first layer relative to the total thickness is preferably 3% or more and 50% or less, more preferably 5% or more and 30% or less from the viewpoint of suppressing the generation of discharge marks.

The thickness of each layer is measured as follows.

Specifically, a section of a first endless belt in the thickness direction is observed with an optical microscope or a scanning electron microscope. The thickness of the layer to be measured is measured at 10 positions. The average of the thicknesses is defined as the thickness of the layer.

Volume Resistivity of First Endless Belt

The common logarithm of a volume resistivity determined when a voltage of 100 V is applied to a first endless belt for five seconds is preferably 9.0 (Log-cm) or more and 13.5 (Log Ω·cm) or less, more preferably 9.5 (Log Ω·cm) or more and 13.2 (Log Ω·cm) or less, particularly preferably 10.0 (Log Ω·cm) or more and 12.5 (Log Ω·cm) or less from the viewpoint of suppressing the generation of discharge marks.

The volume resistivity determined when a voltage of 100 V is applied to a first endless belt for five seconds is measured by the following method.

A micro current meter (R8340A, available from Advantest Corporation) is used as a resistance measuring device, and a UR prove (available from Mitsubishi Chemical Analytech Co., Ltd.) is used as a probe. A volume resistivity (Log Ω·cm) is measured by applying a voltage of 100 V and a pressure of 1 kgf for an application time of five seconds at 18 positions in total, specifically, at three positions of the center and both edges of a first endless belt in the width direction with respect to six positions spaced at regular intervals in the circumferential direction. The average of the values of the volume resistivity is calculated. The measurement is performed in an environment at a temperature of 22° C. and a humidity of 55% RH.

Surface Resistivity of First Endless Belt

The common logarithm of a surface resistivity determined when a voltage of 100 V is applied to an outer peripheral surface of a first endless belt for three seconds is preferably 10.0 (Log Ω/sq.) or more and 15.0 (Log Ω/sq.) or less, more preferably 10.5 (Log Ω/sq.) or more and 14.0 (Log Ω/sq.) or less, particularly preferably 11.0 (Log Ω/sq.) or more and 13.5 (Log Ω/sq.) or less from the viewpoint of suppressing the generation of discharge marks.

The unit Log Ω/sq. of the surface resistivity represents a surface resistivity in terms of the common logarithm of a resistance value per unit area and is also expressed as, for example, Log(∩/sq.), Log Ω/square, or Log Ω/sq.

The surface resistivity determined when a voltage of 100 V is applied to an outer peripheral surface of a first endless belt for three seconds is measured by the following method.

A micro current meter (R8340A, available from Advantest Corporation) is used as a resistance measuring device, and a UR prove (available from Mitsubishi Chemical Analytech Co., Ltd.) is used as a probe. A surface resistivity (Log Ω/sq.) of the outer peripheral surface of a first endless belt is measured by applying a voltage of 100 V and a pressure of 1 kgf for an application time of three seconds at 18 positions in total, specifically, at three positions of the center and both edges of the outer peripheral surface of the first endless belt in the width direction with respect to six positions spaced at regular intervals in the circumferential direction. The average of the values of the surface resistivity is calculated. The measurement is performed in an environment at a temperature of 22° C. and a humidity of 55% RH.

Method for Producing First Endless Belt

The method for producing a first endless belt is not particularly limited.

An example of the method for producing a first endless belt include, for example, a first coating liquid preparation step of preparing a first coating liquid that contains a first resin or a precursor thereof, first conductive carbon particles, and a first solvent, a first coating film formation step of applying the first coating liquid to an outer periphery of an object to be coated to form a first coating film, and a first drying step of drying the first coating film while increasing a temperature of the object to be applied. The method for producing a first endless belt may include another step other than the first coating liquid preparation step, the first coating film formation step, and the first drying step. For example, in the case where a precursor of the first resin is used, the other step may be a first baking step of baking the first coating film dried in the first drying step.

In the case of producing a first endless belt which is a single-layer product, a single layer that includes a first resin and first conductive carbon particles is formed on an outer peripheral surface of an object to be coated, through the first coating liquid preparation step, the first coating film formation step, and the first drying step. The single layer may be, for example, a layer formed by producing pellets that include a first resin and first conductive carbon particles, and subjecting the pellets to melt extrusion.

In the case of producing a first endless belt which is a multilayer product, a first layer that includes a first resin and first conductive carbon particles is formed on an outer peripheral surface of a second layer formed on an object to be coated, for example, through the first coating liquid preparation step, the first coating film formation step, and the first drying step.

In the case of producing a first endless belt which is a multilayer product, a second layer is formed on an outer peripheral surface of an object to be coated, for example, through a second coating liquid preparation step of preparing a second coating liquid that contains a second resin or a precursor thereof, second conductive carbon particles, and a second solvent, a second coating film formation step of applying the second coating liquid to the outer periphery of the object to be coated to form a second coating film, and a second drying step of drying the second coating film. The second layer may be, for example, a layer formed by producing pellets that include a second resin and second conductive carbon particles, and subjecting the pellets to melt extrusion.

Coating Liquid Preparation Step

In the first coating liquid preparation step, a first coating liquid that contains a first resin or a precursor thereof, first conductive carbon particles, and a first solvent is prepared. For example, in the case where the first resin is a polyimide resin and the first conductive carbon particles are carbon black, for example, a solution in which the carbon black is dispersed and a polyamic acid which is a precursor of the polyimide resin is dissolved in the first solvent is prepared as the first coating liquid. For example, in the case where the first resin is a polyamide-imide resin and the first conductive carbon particles are carbon black, for example, a solution in which the carbon black is dispersed and the polyamide-imide resin is dissolved in the first solvent is prepared as the first coating liquid.

From the viewpoints of pulverizing aggregates of the first conductive carbon particles and enhancing dispersibility of the first conductive carbon particles, the first coating liquid may be prepared by a method including performing dispersion treatment by using a pulverizer such as a ball mill or a jet mill.

The first solvent is not particularly limited and may be appropriately determined in accordance with, for example, the type of resin used as the first resin. For example, when the first resin is a polyimide resin or a polyamide-imide resin, polar solvents described below may be used as the first solvent.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylphosphoramide (HMPA), N-methylcaprolactam, N-acetyl-2-pyrrolidone, and 1,3-dimethyl-2-imidazolidinone (N,N-dimethylimidazolidinone, DMI). These polar solvents may be used alone or in combination of two or more thereof.

In the case where the second coating liquid preparation step is performed, a second coating liquid that contains a second resin, second conductive carbon particles, and a second solvent is prepared in the second coating liquid preparation step. The second resin and the second conductive carbon particles are as described above. The method for preparing the second coating liquid and the second solvent are similar to the method for preparing the first coating liquid and the first solvent, respectively.

Coating Film Formation Step

In the first coating film formation step, the first coating liquid is applied to an outer periphery of an object to be coated to form a first coating film.

An example of the object to be coated is a cylindrical or columnar metal mold. The object to be coated may be an object produced by treating an outer peripheral surface of the metal mold with a release agent. In the case of producing a first endless belt which is a single-layer product, in the first coating film formation step, the first coating liquid is directly applied, for example, to the outer peripheral surface of an object to be coated, the object being optionally treated with a release agent. In the case of producing a first endless belt which is a multilayer product, in the first coating film formation step, the first coating liquid is applied, for example, to the outer peripheral surface of an object to be coated, the object having a second layer or a second coating film thereon.

Examples of the method for applying the first coating liquid include publicly known methods such as a spray coating method, a spiral coating (flow coating) method, a blade coating method, a wire bar coating method, a dip coating method, a bead coating method, an air knife coating method, and a curtain coating method.

In the case where the second coating film formation step is performed, in the second coating film formation step, a second coating film is formed by applying the second coating liquid to the outer periphery of the object to be coated. The method for applying the second coating liquid is also similar to the method for applying the first coating liquid.

Drying Step

In the first drying step, the first coating film formed in the first coating film formation step is dried. Through the first drying step, the first solvent included in the first coating film is removed to provide a single layer or a first layer.

Examples of the method for drying the first coating film include a method including supplying hot air to the first coating film and a method including heating the object to be coated.

The speed of hot air on the surface of the first coating film is, for example, in the range of 0.1 m/s or more and 50.0 m/s or less, preferably in the range of 1.0 m/s or more and 40.0 m/s or less, more preferably in the range of 1.0 m/s or more and 20.0 m/s or less.

Herein, the speed of hot air on the surface of the first coating film is measured as follows. Specifically, the speed of hot air is measured by using an anemometer (ANEMOMASTER Model 6036, available from KANOMAX INCORPORATED).

The temperature of hot air on the surface of the first coating film is, for example, in the range of 100° C. or higher and 280° C. or lower, preferably in the range of 100° C. or higher and 250° C. or lower, more preferably in the range of 110° C. or higher and 235° C. or lower.

The temperature of hot air on the surface of the first coating film is measured by connecting a thermometer (e.g., K-type thermocouple, model number: JBS-7115-5M-K, available from GRAPHTEC CORPORATION) to a data recorder (model number: GL240, available from GRAPHTEC CORPORATION).

The method for supplying hot air to the surface of the first coating film include, but are not particularly limited to, a method including blowing hot air of a drying oven from a slit nozzle toward the surface of the first coating film, and a method including directly supplying hot air of a drying oven onto the first coating film. Of these, the method using a slit nozzle may be employed from the viewpoint of easily controlling the speed of the hot air on the surface of the first coating film.

In the case where the second drying step is performed, the second coating film formed in the second coating film formation step is dried in the second drying step. The method for drying the second coating film is similar to the method for drying the first coating film. The second drying step may be completed before the first coating film formation step is performed. Alternatively, the first coating film formation step may be performed before the completion of the second drying step, and the first drying step may also function as part of the second drying step.

Baking Step

As described above, the method for producing a first endless belt may include a first baking step. In the first baking step, the first coating film dried in the first drying step is baked by heating. For example, in the case where the first resin is a polyimide resin, a polyamic acid included in the first coating film is imidized in the first baking step to provide a polyimide.

The heating temperature in the first baking step is, for example, in the range of 150° C. or higher and 450° C. or lower, preferably in the range of 200° C. or higher and 430° C. or lower. The heating time in the first baking step is, for example, in the range of 20 minutes or more and 180 minutes or less, preferably in the range of 60 minutes or more and 150 minutes or less.

In the case where a first endless belt which is a multilayer product is produced and a second layer is formed through the second coating liquid preparation step, the second coating film formation step, and the second drying step, the method may include a second baking step of baking the second coating film dried in the second drying step. The second baking step may also function as the first baking step.

Second Endless Belt

The second endless belt is disposed so as to face the outer peripheral surface of an intermediate transfer body and includes a conductive layer that has a matrix containing an ionically conductive organic polymer material and specific domains formed by aggregates of an electronically conductive conductivity-imparting agent and having particle sizes of 100 nm or more and 3 μm or less, in which the number of the specific domains in a 10 μm×10 μm square of the conductive layer is 20 or more and 50 or less, and a common logarithm of a volume resistivity of the entire second endless belt is 10.0 Log Ω·cm or more and 12.5 Log Ω·cm or less.

The second endless belt is not particularly limited as long as the second endless belt has the shape of an endless belt.

The second endless belt has, for example, a base layer and a surface layer disposed on an outer peripheral surface of the base layer.

Base Layer

The base layer is a conductive layer containing an ionically conductive organic polymer material and an electronically conductive conductivity-imparting agent (hereinafter may be referred to as an "electronically conductive material") and optionally contains another known additive. The base layer has a matrix containing the ionically conductive organic polymer material and specific domains in which the electronically conductive material aggregates and which have particle sizes of 100 nm or more and 3 μm or less, in which the number of the specific domains (that is, the number of domains) in a 10 μm×10 μm square is 20 or more and 50 or less.

Ionically Conductive Organic Polymer Material

The ionically conductive organic polymer material forms a matrix in the base layer. The ionically conductive organic polymer material contained in the base layer may be a resin or rubber material having conductivity. The ionically conductive organic polymer material contained in the base layer may be a rubber material in view of elasticity.

Examples of the rubber material which is the ionically conductive organic polymer material include rubber materials containing a polar rubber.

Examples of the polar rubber include an epichlorohydrin rubber (ECO), a chloroprene rubber (CR), a urethane rubber (U), a fluororubber (FKM), an epichlorohydrin-ethylene oxide copolymer rubber, an epichlorohydrin-ethylene oxide-allyl glycidyl ether copolymer rubber, and an acrylonitrile-butadiene copolymer rubber (NBR). The rubber material may contain only one of these polar rubbers or two or more of these polar rubbers.

The rubber material preferably contains at least one selected from the group consisting of an epichlorohydrin rubber, a chloroprene rubber, and an acrylonitrile-butadiene copolymer rubber, more preferably contains an epichlorohydrin rubber.

The rubber material which is the ionically conductive organic polymer material may contain another rubber other than the polar rubber. That is, the rubber material which is the ionically conductive organic polymer material may be a rubber mixture of the polar rubber and another rubber given below.

Examples of the other rubber include an isoprene rubber (IR), a butyl rubber (IIR), a silicone rubber (Q), a styrene-butadiene rubber (SBR), a butadiene rubber (BR), an ethylene propylene rubber (EPM), an ethylene-propylene-diene terpolymer rubber (EPDM), and a natural rubber (NR).

In the case where the rubber material contains another rubber other than the polar rubber, the other rubber may contain an ethylene-propylene-diene terpolymer rubber.

The content of the rubber material in the base layer is preferably 50% by mass or more and 90% by mass or less, more preferably 70% by mass or more and 85% by mass or less, particularly preferably 75% by mass or more and 80% by mass or less.

From the viewpoint of controlling the electrical resistance, the ionically conductive organic polymer material is preferably a rubber material produced by blending EPDM, CR, ECO, and NBR as rubber components. These rubber components are more preferably contained, for example, in the following mass ratio relative to 100% by mass of the rubber material.

EPDM: 20% by mass to 45% by mass (more preferably 35% by mass to 40% by mass)

CR: 20% by mass to 40% by mass (more preferably 30% by mass to 35% by mass)

ECO: 0% by mass to 20% by mass (more preferably 10% by mass to 15% by mass)

NBR: 0% by mass to 15% by mass

Electronically Conductive Material

The electronically conductive material contained in the base layer aggregates to form domains in the base layer. For example, in the base layer, 20 to 50 specific domains (aggregates) formed by aggregation of the electronically conductive material and having particle sizes of 100 nm or more and 3 μm or less are present in a 10 μm×10 μm square.

From the viewpoint that when a high voltage is applied, the concentration of a current in the matrix is suppressed and dielectric breakdown between the domains is reduced, the number of domains is preferably 25 or more and 40 or less.

Although a certain number of domains having particle sizes of less than 100 nm may be present in the base layer, the area ratio of the specific domains having particle sizes of 100 nm or more and 3 μm or less to the total area of the domains formed of the electronically conductive material is preferably 60% or more, more preferably 80% or more, and particularly preferably 100%. That is, particularly preferably, no domains having particle sizes of less than 100 nm are present. Preferably, no domains having sizes of more than 3 μm are present because the concentration of an electric field in such domains may cause dielectric breakdown.

The electronically conductive material may be at least one selected from the group consisting of carbon black, pyrolytic carbon, graphite, conductive metals and alloys, conductive metal oxides, and insulating materials having surfaces subjected to conductivity-imparting treatment.

Specific examples of the electronically conductive material include carbon black such as Ketjenblack and acetylene black; pyrolytic carbon; graphite; various conductive metals and alloys such as aluminum, copper, nickel, and stainless steel; various conductive metal oxides such as tin oxide, indium oxide, titanium oxide, tin oxide-antimony oxide solid solution, and tin oxide-indium oxide solid solution; and insulating materials having surfaces subjected to conductivity-imparting treatment. These electronically conductive materials may be used alone or in combination of two or more thereof.

Of these, carbon black may be used from the viewpoint of reducing an environmental change in the resistance of the belt. The carbon black may be oxidation-treated carbon black (e.g., carbon black obtained by providing a carboxyl group, a quinone group, a lactone group, a hydroxyl group, or the like to the surface thereof) having a pH of 5 or less (preferably a pH of 4.5 or less, more preferably a pH of 4.0 or less) in view of stability of the electrical resistance over time and electric field dependence for reducing the electric field concentration due to the transfer voltage.

The electronically conductive material may have a number-average primary particle size of, for example, 35 nm or less (preferably 24 nm or less, more preferably 16 nm or less). When the number-average primary particle size of the electronically conductive material is within this range, the electronically conductive material easily aggregates to form domains having particle sizes of 100 nm or more and 3 μm or less.

In particular, carbon black having a number-average primary particle size of 24 nm or less forms fine and highly uniform conductive paths. Consequently, a decrease in the resistance due to discharge degradation on the surface of the belt is easily suppressed.

The number-average primary particle size of carbon black is preferably as small as possible from the viewpoint described above. However, the number-average primary particle size of carbon black may be 10 nm or more (preferably 12 nm or more) for the following reason. At an excessively small number-average primary particle size, carbon black has a low bulk density, and it is difficult to handle the carbon black. Furthermore, such carbon black has a large specific surface area, and thus the resulting dispersion exhibits thixotropy.

The number-average primary particle size of carbon black is measured by the following method.

A measurement sample having a thickness of 200 nm is taken from the base layer of the second endless belt by cutting with a microtome. The measurement sample is observed with a transmission electron microscope (TEM). Subsequently, the size of each of 50 primary particles of carbon black is measured. The average of the sizes is defined as the number-average primary particle size of the carbon black.

The content of the electronically conductive material in the base layer may be 1% by mass or more and 50% by mass or less (preferably 10% by mass or more and 40% by mass or less, more preferably 20% by mass or more and 30% by mass or less) relative to all the components of the base layer, although it depends on the target resistance. When the content of the electronically conductive material is within this range, the number of domains is easily controlled to 20 or more and 50 or less.

Insulating or semiconductive particles may be added to the base layer so as to adjust the volume resistivity of the base layer. Examples of such substances include silica and zinc oxide (flowers of zinc).

The base layer may further contain compounding ingredients for rubber, such as ingredients given below.

Examples of a filler include titanium oxide, magnesium oxide, calcium carbonate, calcium sulfate, clay, and talc. Examples of a chemical for rubber include vulcanizing agents, vulcanization accelerators, anti-aging agents, plasticizers, and process oils. Examples of a colorant include various pigments.

Furthermore, other compounding ingredients such as acid acceptors and reinforcing agents may be added.

The thickness of the base layer is not particularly limited. The base layer preferably has a thickness of 100 μm or more and 1,000 μm or less, more preferably 300 μm or more and 600 μm or less from the viewpoint of, for example, strength, reduction of a change in permanent elongation, prevention of breakage or tears during belt rubbing, and surface smoothness.

Surface Layer

The surface layer is a layer that is optionally provided on the base layer. The surface layer contains, for example, a resin material, a conductive agent, and optionally publicly known additives.

The base layer, which is composed of a rubber or the like, tends to crease, and a discharge product generated during image formation easily adheres to the base layer. The surface layer provided on the outer peripheral surface of the base layer easily reduces the formation of creases and the adhesion of a discharge product, a toner, and other contaminants.

Resin

Examples of the resin that forms the surface layer include polyurethane resins, polyester resins, and polyacrylic resins.

Conductive Agent

The conductive agent included in the surface layer is not particularly limited. From the viewpoint of reducing an environmental change in the resistance of the belt, an electronically conductive material may be used. Specifically, carbon black may be used.

In particular, the carbon black may be oxidation-treated carbon black (e.g., carbon black obtained by providing a carboxyl group, a quinone group, a lactone group, a hydroxyl group, or the like to the surface thereof) having a pH of 5 or less (preferably a pH of 4.5 or less, more preferably a pH of 4.0 or less) in view of stability of the electrical resistance over time and electric field dependence for reducing the electric field concentration due to the transfer voltage.

The carbon black having a pH of 5 or less is similar to that described above for the electronically conductive material in the base layer.

The content of the conductive agent in the surface layer is selected in accordance with the target resistance. For example, the content of the conductive agent is 1% by mass or more and 50% by mass or less, preferably 2% by mass or more and 40% by mass or less, still more preferably 4% by mass or more and 30% by mass or less relative to all the components of the layer.

The conductive agents in the surface layer may be used alone or in combination of two or more thereof.

The surface layer may have a thickness of, for example, 2 μm or more and 30 μm or less, preferably 5 μm or more and 15 μm or less.

Characteristics of Second Endless Belt

Surface Resistivity and Volume Resistivity

The common logarithm of a volume resistivity of the entire second endless belt is 10.0 Log Ω·cm or more and 12.5 Log Ω·cm or less, preferably 10.0 Log Ω·cm or more and 11.6 Log Ω·cm or less. When the common logarithm of the volume resistivity of the entire second endless belt is 10.0 Log Ω·cm or more, a transfer defect at an edge of a sheet due to current leakage to a non-paper-feed area is suppressed.

When the common logarithm of the volume resistivity of the entire second endless belt is 12.5 Log Ω·cm or less, problems caused by discharge due to an increase in the transfer voltage are suppressed.

The common logarithm of a surface resistivity of the outer peripheral surface of the entire second endless belt is preferably 8.5 Log Ω/sq. or more and 11.0 Log Ω/sq. or less, more preferably 10.0 Log Ω/sq. or more and 11.0 Log Ω/sq. or less.

Figure 1B:
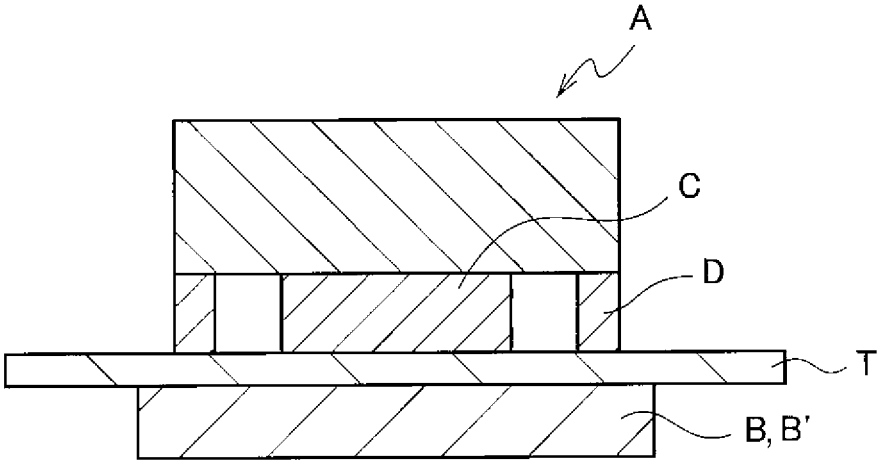

The surface resistivity is measured as follows. The surface resistivity is measured by using a circular electrode (for example, "UR probe" for HIRESTA-IP available from Mitsubishi Chemical Corporation) in accordance with JIS K6911 (1995). The method for measuring the surface resistivity will be described with reference to drawings. FIGS. 1A and 1B are a schematic plan view and a schematic sectional view, respectively, of an example of a circular electrode. The circular electrode illustrated in FIGS. 1A and 1B includes a first voltage applying electrode A and a planar insulator B. The first voltage applying electrode A includes a columnar electrode part C and an annular electrode part D. The annular electrode part D has an inner diameter larger than the outer diameter of the columnar electrode part C and surrounds the columnar electrode part C at a certain distance. A belt T is disposed between a set of the columnar electrode part C and the annular electrode part D of the first voltage applying electrode A and the planar insulator B. A voltage V (V) is applied between the columnar electrode part C and the annular electrode part D of the first voltage applying electrode A, and a current I (A) that flows therebetween is measured. The surface resistivity ρs (Ω/sq.) of the transfer surface of the belt T is calculated by the following equation:

$$\rho s=\pi\times(D+d)/(D-d)\times(V/I)$$

where d (mm) represents the outer diameter of the columnar electrode part C, and D (mm) represents the inner diameter of the annular electrode part D.

The surface resistivity is calculated from the current measured in an environment at 22° C. and 55% RH after a voltage of 500 V is applied for ten seconds by using the circular electrode (UR Probe for HIRESTA-IP available from Mitsubishi Chemical Corporation, outer diameter of columnar electrode part C: 16 mm, inner diameter of annular electrode part D: 30 mm, outer diameter of annular electrode part D: 40 mm).

The volume resistivity is measured by using a circular electrode (for example, UR probe for HIRESTA-IP available from Mitsubishi Chemical Corporation) in accordance with JIS K6911 (1995). The method for measuring the volume resistivity will be described with reference to FIGS. 1A and 1B. The volume resistivity is measured by using the same apparatus as that used for measuring the surface resistivity. However, the circular electrode illustrated in FIGS. 1A and 1B includes a second voltage applying electrode B' instead of the planar insulator B used in the measurement of the surface resistivity. The belt T is disposed between the set of the columnar electrode part C and the annular electrode part D of the first voltage applying electrode A and the second voltage applying electrode B'. A voltage V (V) is applied between the columnar electrode part C of the first voltage applying electrode A and the second voltage applying electrode B', and a current I (A) that flows therebetween is measured. The volume resistivity ρv (cm) of the belt T is calculated by the following equation:

$$\rho v=19.6\times(V/I)\times t$$

where t represents a thickness of the belt T.

The volume resistivity is calculated from the current measured in an environment at 22° C. and 55% RH after a voltage of 500 V is applied for ten seconds by using the circular electrode (UR Probe for HIRESTA-IP available from Mitsubishi Chemical Corporation, outer diameter of columnar electrode part C: 16 mm, inner diameter of annular electrode part D: 30 mm, outer diameter of annular electrode part D: 40 mm).

The coefficient 19.6 in the above equation is an electrode coefficient for conversion to resistivity. This coefficient is calculated as $\pi d^2/4t$ from the outer diameter d (mm) of the columnar electrode part C and the thickness t (cm) of the sample. The thickness of the belt T is measured by using an eddy-current thickness meter CTR-1500E available from Sanko Electronic Laboratory Co., Ltd.

The surface resistivity and the volume resistivity of the second endless belt are controlled by, for example, the type of ionically conductive organic polymer material, the type of electronically conductive material, and the amount of electronically conductive material.

Method for Producing Conductive Member

The method for producing a second endless belt is not particularly limited. For example, the above-described endless belt having a base layer and a surface layer may be produced by any method as long as the base layer has a matrix containing an ionically conductive organic polymer material and domains formed by aggregates of an electronically conductive material. The endless belt is produced by, for example, forming a base layer, and subsequently forming a surface layer on the outer peripheral surface of the base layer, as described below.

First, the base layer is formed as follows. A rubber composition containing, for example, a rubber material such as a chloroprene rubber or an EPDM, an electronically conductive material, a vulcanizing agent, and a vulcanization accelerator is fed to a Banbury mixer and kneaded.

Furthermore, the resulting rubber composition is sufficiently kneaded with rolls, and the kneaded product is then molded into an endless belt by using a tube crosshead extruder. The rubber composition molded to have an endless belt shape is vulcanized by heating with pressurized steam in a vulcanization can to form a base rubber. The resulting base is fitted on the outside of a metal tube, and the surface of the base is polished. Thus, a base layer having the shape of an endless belt is obtained.

The apparatus used for kneading the rubber composition is not limited to the Banbury mixer. Examples of the apparatus include closed kneaders such as a pressure kneader and open kneaders such as an open-roll mill.

In the case where the base layer is formed as described above, for example, after a rubber composition is prepared by kneading an EPDM and carbon black (CB) in advance, the rubber composition may be further blended with, for example, other rubber materials, an electronically conductive material, a vulcanizing agent, and a vulcanization accelerator, and the resulting rubber composition may be kneaded. In this case, aggregates of the electronically conductive material are easily formed. For example, the specific domains are formed, and it is easy to adjust the number of domains to 20 or more and 50 or less. The rubber composition may optionally be passed through a mesh screen to sieve the aggregates of the electronically conductive material, thereby adjusting the particle size of the aggregates of the electronically conductive material in the rubber composition.

The method for forming the surface layer on the outer peripheral surface of the base layer is not particularly limited. For example, the surface layer may be formed by applying a coating liquid for forming a surface layer, the coating liquid being prepared by dispersing a resin and a conductive agent, to the base layer by a dip coating method, a spray coating method, an electrostatic coating method, a roll coating method, or the like, and then drying the coating liquid.

Image Forming Apparatus

An image forming apparatus according to an exemplary embodiment includes an image carrier, a charging device that charges a surface of the image carrier, an electrostatic latent image forming device that forms an electrostatic latent image on the charged surface of the image carrier, a developing device that houses a developer containing a toner and that develops the electrostatic latent image formed on the surface of the image carrier by using the developer to form a toner image, and a transfer device that transfers the toner image to a surface of a recording medium, in which the transfer device described above is used as the transfer device.

The image forming apparatus according to the exemplary embodiment may be, for example, a common monochrome image forming apparatus including a developing device that houses only a monochrome toner, a color image forming apparatus that sequentially repeatedly first-transfers toner images carried on image carriers to an intermediate transfer belt, or a tandem-type color image forming apparatus in which plural image carriers including developing units for respective colors are arranged in tandem along an intermediate transfer belt.

Figure 2:
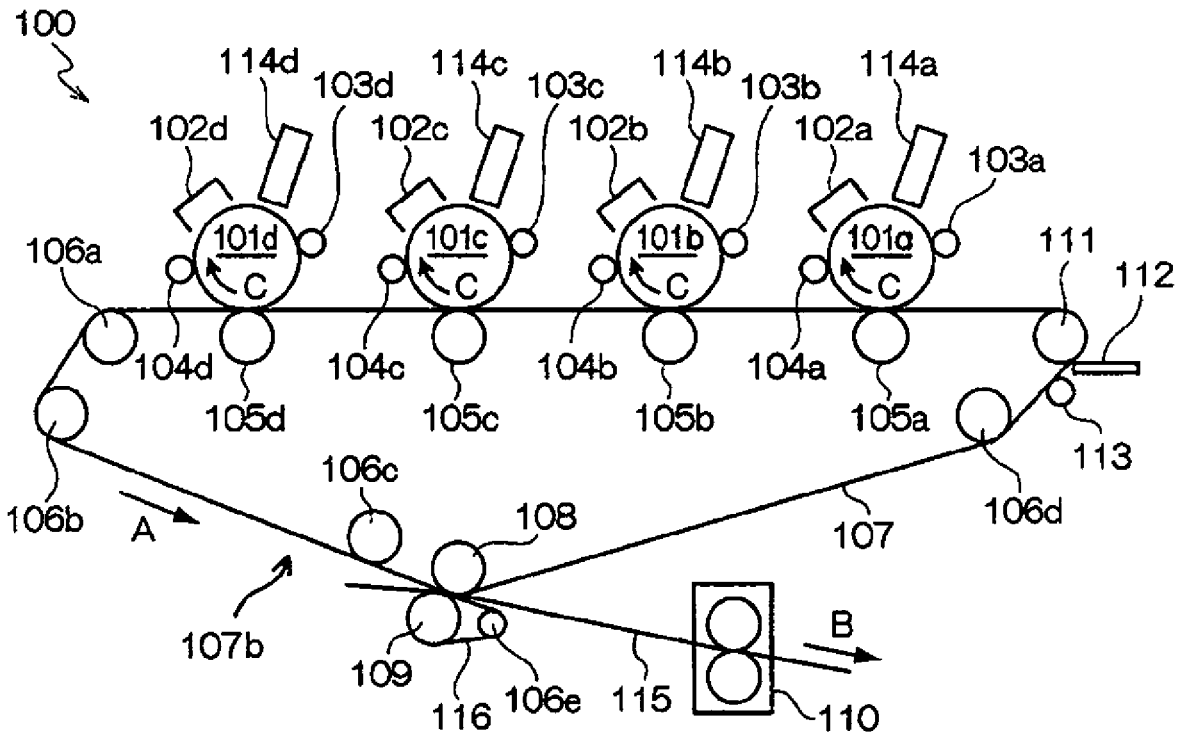
FIG. 2 is a schematic diagram illustrating an example of an image forming apparatus according to an exemplary embodiment.

FIG. 2 is a schematic diagram illustrating an example of an image forming apparatus according to the exemplary embodiment. The image forming apparatus illustrated in FIG. 2 is an image forming apparatus in which the first endless belt in the transfer device described above is applied to an intermediate transfer belt 107, and the second endless belt in the transfer device is applied to a second transfer belt 116.

Referring to FIG. 2, an image forming apparatus 100 according to this exemplary embodiment is, for example, a so-called tandem system in which charging devices 102*a* to 102*d*, exposure devices 114*a* to 114*d*, developing devices 103*a* to 103*d*, first transfer devices (first transfer rollers) 105*a* to 105*d*, and image carrier cleaning devices 104*a* to 104*d* are sequentially arranged around four image carriers 101*a* to 101*d* formed of electrophotographic photoreceptors in the direction of rotation of the image carriers 101*a* to 101*d*. An erasing device may be provided in order to erase residual potential remaining on the surfaces of the image carriers 101*a* to 101*d* after transfer.

The intermediate transfer belt 107 is supported by support rollers 106*a* to 106*d*, a driving roller 111, and an opposing roller 108 so that a tension is applied to the intermediate transfer belt 107, thus forming a transfer unit 107*b*. The intermediate transfer belt 107 can be moved, by the support rollers 106*a* to 106*d*, the driving roller 111, and the opposing roller 108, between the image carriers 101*a* to 101*d* and the first transfer rollers 105*a* to 105*d* in the direction of an arrow A while being in contact with the surfaces of the image carriers 101*a* to 101*d*. Portions where the first transfer rollers 105*a* to 105*d* come in contact with the image carriers 101*a* to 101*d* with the intermediate transfer belt 107 therebetween function as first transfer portions. A first transfer voltage is applied to the contact portions between the image carriers 101*a* to 101*d* and the first transfer rollers 105*a* to 105*d*.

The opposing roller 108 and a second transfer roller 109 that are disposed so as to face each other with the intermediate transfer belt 107 and the second transfer belt 116 therebetween are provided as a second transfer device. The second transfer belt 116 is supported by the second transfer roller 109 and a support roller 106*e*. A recording medium 115 such as a paper sheet moves through a region sandwiched between the intermediate transfer belt 107 and the second transfer roller 109 in the direction of an arrow B while being in contact with the surface of the intermediate transfer belt 107, and then passes through a fixing device 110. A portion where the second transfer roller 109 comes in contact with the opposing roller 108 with the intermediate transfer belt 107 and the second transfer belt 116 therebetween functions as a second transfer portion. A second transfer voltage is applied to the contact portion between the second transfer roller 109 and the opposing roller 108. Furthermore, intermediate transfer belt cleaning devices 112 and 113 are disposed so as to come in contact with the intermediate transfer belt 107 after transfer.

In the multicolor image forming apparatus 100 having this structure, the image carrier 101*a* rotates in the direction of an arrow C, the surface of the image carrier 101*a* is charged by the charging device 102*a*, and an electrostatic latent image of a first color is then formed by the exposure device 114*a* such as a laser beam. The electrostatic latent image formed as described above is developed (visualized) with a developer containing a toner of the corresponding color by the developing device 103*a* that houses the toner so as to form a toner image. The developing devices 103*a* to 103*d* house toners corresponding to the electrostatic latent images of respective colors (for example, yellow, magenta, cyan, and black).

The toner image formed on the image carrier 101*a* is electrostatically transferred (first-transferred) to the intermediate transfer belt 107 by the first transfer roller 105*a* when the toner image passes through the first transfer portion. Subsequently, toner images of a second color, a third color, and a fourth color are first-transferred to the intermediate transfer belt 107, which carries the toner image of the first color, by using the first transfer rollers 105*b* to 105*d* so that the toner images are sequentially superimposed. Consequently, a multicolor superimposed toner image is finally formed.

The superimposed toner image formed on the intermediate transfer belt 107 is collectively electrostatically transferred to the recording medium 115 transported by the second transfer belt 116 when the superimposed toner image passes through the second transfer portion. The recording medium 115 to which the toner image is transferred is transported to the fixing device 110, subjected to a fixing process by heating and/or pressing, and then discharged to the outside of the apparatus.

The residual toner on the image carriers 101*a* to 101*d* after the first transfer is removed by the image carrier cleaning devices 104*a* to 104*d*. On the other hand, the residual toner on the intermediate transfer belt 107 after the second transfer is removed by the intermediate transfer belt cleaning devices 112 and 113 so that the intermediate transfer belt 107 is prepared for the next image forming process.

Image Carrier

A wide variety of publicly known electrophotographic photoreceptors may be used as the image carriers 101*a* to 101*d*. The electrophotographic photoreceptors may be, for example, inorganic photoreceptors including photosensitive layers composed of inorganic materials or organic photoreceptors including photosensitive layers composed of organic materials. In the organic photoreceptors, function-separated organic photoreceptors in which a charge generation layer that generates charges due to exposure with light and a charge transport layer that transports charges are stacked or single-layer organic photoreceptors having a function of generating charges and a function of transporting charges are suitably used. In the inorganic photoreceptors, photoreceptors including photosensitive layers composed of amorphous silicon are suitably used.

The shape of each of the image carriers is not particularly limited, and a publicly known shape such as a cylindrical drum shape, a sheet shape, or a plate shape may be employed.

Charging Device

The charging devices 102*a* to 102*d* are not particularly limited, and a wide variety of publicly known chargers may be used. Examples thereof include contact-type chargers that use a conductive roller, brush, film, rubber blade, or the like, and scorotron and corotron chargers, which use corona discharge. Of these, the contact-type chargers are preferred.

The charging devices 102*a* to 102*d* typically apply a direct current to the image carriers 101*a* to 101*d*, respectively. Alternatively, the charging devices 102*a* to 102*d* may apply a direct current on which an alternating current is superimposed to the image carriers 101*a* to 101*d*, respectively.

Exposure Device

The exposure devices 114*a* to 114*d* are not particularly limited, and a wide variety of publicly known exposing devices may be used. Examples thereof include light sources such as semiconductor laser light, light emitting diode (LED) light, and liquid crystal shutter light, and optical devices capable of exposing a predetermined image pattern by using light from any of these light sources through a polygon mirror.

Developing Device

The developing devices 103*a* to 103*d* are selected according to the purpose. Examples thereof include publicly known developing units that develop one-component developers or two-component developers in a contact or non-contact manner by using brushes, rollers, or the like.

First Transfer Roller

The first transfer rollers 105*a* to 105*d* may each be constituted by a single layer or plural layers. For example, in the case where the first transfer rollers 105*a* to 105*d* have a single-layer structure, the first transfer rollers 105*a* to 105*d* are constituted by rollers composed of a foamed or non-foamed rubber such as a silicone rubber, urethane rubber, or EPDM containing a suitable amount of conductive particles such as carbon black.

Image Carrier Cleaning Device

The image carrier cleaning devices 104*a* to 104*d* are devices for removing residual toner adhering to the surfaces of the image carriers 101*a* to 101*d* after the first transfer step. Besides cleaning blades, brush cleaning, roller cleaning, or the like may be used. Of these, cleaning blades are preferably used. Examples of the material of the cleaning blades include a urethane rubber, a neoprene rubber, and a silicone rubber.

Second Transfer Roller

The layer structure of the second transfer roller 109 is not particularly limited. For example, in the case where the second transfer roller 109 has a three-layer structure, the second transfer roller 109 is constituted by a core layer, an intermediate layer, and a coating layer covering the surface of the intermediate layer. The core layer is composed of a foamed rubber such as a silicone rubber, urethane rubber, or EPDM in which conductive particles are dispersed, and the intermediate layer is composed of a non-foamed rubber such as a silicone rubber, urethane rubber, or EPDM. Examples of the material of the coating layer include tetrafluoroethylenehexafluoropropylene copolymers and perfluoroalkoxy resins. The second transfer roller 109 preferably has a volume resistivity of 107 Ωcm or less. Alternatively, the second transfer roller 109 may have a two-layer structure excluding the intermediate layer.

Opposing Roller

The opposing roller 108 forms a counter electrode for the second transfer roller 109. The opposing roller 108 may have a single-layer structure or a multilayer structure. For example, in the case where the opposing roller 108 has a single-layer structure, the opposing roller 108 is constituted by a roller composed of a rubber such as a silicone rubber, urethane rubber, or EPDM containing a suitable amount of conductive particles such as carbon black. In the case where the opposing roller 108 has a two-layer structure, the opposing roller 108 is constituted by a roller that includes an elastic layer composed of the rubber material described above and a high-resistance layer covering an outer peripheral surface of the elastic layer.

A voltage of 1 kV or more and 6 kV or less is usually applied to the cores of the opposing roller 108 and the second transfer roller 109. A voltage may be applied to the second transfer roller 109 and an electrode member that has good electrical conductivity and that is brought into contact with the opposing roller 108 instead of applying a voltage to the core of the opposing roller 108. The electrode member may be a metal roller, a conductive rubber roller, a conductive brush, a metal plate, a conductive resin plate, or the like.

Fixing Device

A wide variety of publicly known fixing units may be used as the fixing device 110. The fixing device 110 may be, for example, a heat roller fixing unit, a pressure roller fixing unit, or a flash fixing unit.

Intermediate Transfer Belt Cleaning Device

The intermediate transfer belt cleaning devices 112 and 113 may be cleaning blades, brushes, rollers, or the like. Of these, cleaning blades are preferably used. Examples of the material of the cleaning blades include a urethane rubber, a neoprene rubber, and a silicone rubber.

Recording Medium

Examples of the recording medium 115 include paper, coated paper produced by coating the surface of paper with a resin or the like, cloths, nonwoven fabrics, resin films, and resin sheets.

The thickness of the recording medium 115 is, for example, in the range of 50 μm or more and 300 μm or less. In the exemplary embodiment, the L(r) integrated value in the first endless belt is 0 or more and 0.1 or less. Accordingly, discharge marks in the second endless belt may be reduced, even if the recording medium has a thickness of 300 μm or more.

The basis weight of the recording medium 115 is, for example, in the range of 50 $g/m^2$ or more and 400 $g/m^2$ or less. In the exemplary embodiment, the L(r) integrated value in the first endless belt is 0 or more and 0.1 or less. Accordingly, discharge marks in the second endless belt may be reduced, even if the recording medium has a basis weight of more than 300 $g/m^2$.

The exemplary embodiments have been described above. It is to be understood that the exemplary embodiments are not restrictive, and various modifications, variations, and improvements may be made to the exemplary embodiments.

EXAMPLES

Examples of the present disclosure will now be described, but the present disclosure is not limited to the following Examples. In the following description, "part" and "%" are all on a mass basis, unless otherwise specified. Production of Intermediate Transfer Body (First Endless Belt)

Production of Intermediate Transfer Body A

To 1,000 g of a wholly aromatic polyimide varnish (solid content: 18% by weight, U-Imide KX, available from UNITIKA LTD., solvent: NMP), 36 g (20 phr) of oxidation-treated gas black (FW200, available from Orion Engineered Carbons, number-average primary particle size: 13 nm) is added as first conductive carbon particles. Dispersion treatment of the resulting mixture is performed as follows by using a high-pressure collision-type disperser (available from Genus). The mixture is allowed to pass through an orifice with a diameter of 0.1 mm at a pressure of 200 MPa, the resulting slurry is divided into two portions, and the slurry portions are allowed to collide with each other. This operation is conducted five times to prepare a coating liquid A which is a first coating liquid.

The coating liquid A prepared as described above is applied to an outer surface of a SUS pipe with a diameter ϕ of 429.5 by a flow coating method so as to have a predetermined film thickness and dried at 150° C. for 30 minutes while the SUS pipe is rotated. Subsequently, the SUS pipe is placed in an oven at 340° C. for one hour and then removed from the oven. Thus, the SUS pipe having an endless belt 1A on the outer surface thereof is obtained. The endless belt 1A has a total film thickness (that is, a film thickness of the single layer) of 80 μm.

The endless belt 1A formed on the outer surface is removed from the SUS pipe and cut to have a width of 360 mm. As a result, an intermediate transfer body A which is a belt-shaped intermediate transfer body is obtained. The content of the conductive carbon particles relative to the entire intermediate transfer body A is 16.7% by mass.

For the intermediate transfer body A, the volume resistivity and the surface resistivity of the outer peripheral surface are measured by the methods described above. According to the results, the common logarithm of the volume resistivity is 10.1 (Log Ω·cm).

Production of Intermediate Transfer Body B

An endless belt 1B is obtained as in the endless belt 1A except that 37.8 g (21 phr) of oxidation-treated gas black (FW200, available from Orion Engineered Carbons, number-average primary particle size: 13 nm) is used as the first conductive carbon particles, and resulting slurry portions are allowed to collide with each other ten times by using the high-pressure collision-type disperser (available from Genus). An intermediate transfer body B which is a belt-shaped intermediate transfer body is then obtained. The endless belt 1B has a total film thickness (that is, a film thickness of the single layer) of 80 μm. The content of the conductive carbon particles relative to the entire intermediate transfer body B is 17.4% by mass.

For the intermediate transfer body B, the volume resistivity and the surface resistivity of the outer peripheral surface are measured by the methods described above. According to the results, the common logarithm of the volume resistivity is 10.0 (Log Ω·cm).

Production of Intermediate Transfer Body C

An endless belt 1C is obtained as in the endless belt 1A except that 50.4 g (28 phr) of oxidation-treated gas black (SB4, available from Orion Engineered Carbons, number-average primary particle size: 25 nm) is used as the first conductive carbon particles. An intermediate transfer body C which is a belt-shaped intermediate transfer body is then obtained. The endless belt 1C has a total film thickness (that is, a film thickness of the single layer) of 80 μm. The content of the conductive carbon particles relative to the entire intermediate transfer body C is 21.9% by mass.

For the intermediate transfer body C, the volume resistivity and the surface resistivity of the outer peripheral surface are measured by the methods described above. According to the results, the common logarithm of the volume resistivity is 10.0 (Log Ω·cm).

Production of Second Transfer Belt (Second Endless Belt)

Production of Second Transfer Belt A1

Formation of Base Rubber Layer

A rubber composition is prepared by blending the following components in the ratio shown in Table 1.

Formation of Surface Layer

A coating liquid for forming a surface layer is prepared by blending 20 parts by mass of carbon black "FW200" available from Orion Engineered Carbons with 100 parts by mass of a silicone-modified acrylic urethane (JYL841 available from Acheson Japan Ltd.).

The resulting coating liquid for forming a surface layer is applied to the surface of the base rubber layer by spray coating and then dried by heating at 180° C. for 30 minutes to form a surface layer (thickness: 8 μm).

A second transfer belt A1 having a diameter of 40 mm, a width of 340 mm, and a thickness of 500 μm is produced by the method described above.

Production of Second Transfer Belts A2, A3, B1, B2, and C1

Second transfer belts A2, A3, B1, B2, and C1 are produced as in the second transfer belt A1 except that the formulation of the rubber composition and the kneading method are changed in accordance with Table 1.

TABLE 1

| Second transfer belt | | A1 | A2 | A3 | B1 | B2 | C1 |
|---|---|---|---|---|---|---|---|
| Formulation | EPDM | 35 | 35 | 35 | 25 | 45 | 30 |
| | CR | 35 | 35 | 35 | 35 | 20 | 40 |
| | ECO | 15 | 15 | 15 | 25 | 15 | 15 |
| | NBR | 15 | 15 | 15 | 15 | 15 | 15 |
| | CB | 23.5 | 23 | 21 | 28 | 23 | 20 |
| | Sulfur | 0.5 | 0.5 | 0.5 | 0.5 | 0.5 | 0.5 |
| | ZnO | 5 | 5 | 5 | 5 | 5 | 5 |
| | Vulcanization accelerator | 1 | 1 | 1 | 1 | 1 | 1 |
| | Stearic acid | 0.5 | 0.5 | 0.5 | 0.5 | 0.5 | 0.5 |
| Kneading method | | Banbury mixer | Banbury mixer | Banbury mixer | Banbury mixer | Banbury mixer | Banbury mixer |

EPDM: (ethylene-propylene-diene rubber, EP33 available from JSR Corporation)

CR: (chloroprene rubber, TSR-61 available from Tosoh Corporation)

ECO: (epichlorohydrin rubber, 610 available from Osaka Soda Co., Ltd.)

NBR: (nitrile-butadiene rubber, DN211 available from Zeon Corporation)

Electronically conductive material: CB (carbon black, #3030B available from Mitsubishi Chemical Corporation, number-average primary particle size: 55 nm)

Sulfur: (available from Tsurumi Chemical Industry Co., Ltd.)

ZnO: (available from Kyoudou Kagaku Co., Ltd.)

Vulcanization accelerator: (NOCCELER M available from Ouchi Shinko Chemical Industrial Co., Ltd.)

Stearic Acid:

The rubber composition prepared by blending the above components in the ratio shown in Table 1 is fed to a Banbury mixer and kneaded, and the resulting rubber composition is then kneaded with two rolls. The kneaded product obtained as described above is molded into an endless belt by using a tube crosshead extruder.

Subsequently, the rubber composition molded into the endless belt is vulcanized by heating with pressurized steam (temperature: 126° C., pressure: 1.5 kg/cm$^2$) in a vulcanization can to form a base rubber. The resulting base rubber is fitted on the outside of a metal tube, and the surface of the base rubber is polished. Thus, a base rubber layer (diameter: 40 mm, width: 340 mm, thickness: 492 μm) having the shape of an endless belt is obtained.

Measurement of Endless Belt

The L(r) integrated value in the intermediate transfer bodies, the number of domains in the second transfer belts, the area ratio of specific domains to the total area of the domains in the second transfer belts, and the common logarithm of the volume resistivity of the second transfer belts are measured by the methods described above. Table 2 shows the results.

Production of Image Forming Apparatus

Each combination of the intermediate transfer body and the second transfer belt shown in Table 2 is incorporated in a modified apparatus (that is, a modified apparatus modified so that a second transfer belt is mounted) of an image forming apparatus (Versant 2000, available from Fuji Xerox Co., Ltd.). Thus, image forming apparatuses of Examples 1 to 4, Comparative Examples 1 to 4, and Reference Examples 1 and 2 are obtained.

Evaluation

Evaluation of Transferability

A halftone image with an image density of 200% is continuously formed on 100 sheets of paper (size: A3, J paper, available from Fuji Xerox Co., Ltd., basis weight: 82 g/m$^2$, thickness: 97 μm) in an environment at 10° C. and 15% RH. The image quality of the resulting images is evaluated as described below. The evaluation criteria are as follows. Table 2 shows the results.

A: No color unevenness is generated on the images.

B: No color unevenness recognized by visual observation is generated on the images.

C: Slight color unevenness is generated.

D: Color unevenness and a missing color are partly generated.

E: Color unevenness and a missing color are generated over the entire images.

Evaluation of Increase in Resistance of Second Transfer Member

A halftone image with an image density of 200% is continuously formed on 800,000 sheets of paper (size: A3, J paper, available from Fuji Xerox Co., Ltd., basis weight: 82 g/m$^2$, thickness: 97 μm) in an environment at 10° C. and 15% RH. The volume resistance values before and after the paper feed (800,000-sheet image formation) are measured by the resistance measurement method described above. The change in the resistance after conduction is calculated and evaluated in accordance with the following evaluation criteria. Table 2 shows the results.

A: The difference in resistance between before and after conduction is less than 0.2 [Log Ω·cm].

B: The difference in resistance between before and after conduction is 0.2 [Log Ω·cm] or more and less than 0.5 [Log Ω·cm].

C: The difference in resistance between before and after conduction is 0.5 [Log Ω·cm] or more and less than 1.5 [Log Ω·cm].

D: The difference in resistance between before and after conduction is 1.5 [Log Ω·cm] or more.

Evaluation of Discharge Mark of Second Transfer Member

A halftone image with an image density of 200% is continuously formed on 100,000 sheets of cardboard (size: A3, basis weight: 300 g/m$^2$) in an environment at 10° C. and 15% RH. The surface of the second transfer member after the paper feed (100,000-sheet image formation) is observed. The generation of discharge marks is examined and evaluated in accordance with the following evaluation criteria. Table 2 shows the results.

A: No discharge mark is generated.

B: Slight discharge marks are generated, but there is no problem with image quality.

C: Several discharge marks are generated. A missing color is generated on the images.

D: A large number of discharge marks are generated. A missing color is generated on the images.

The results shown in Table b show that, in Examples, the generation of discharge marks of the second transfer member is suppressed compared with Comparative Example 1. The results also show that, in Examples, the increase in the resistance is suppressed compared with Comparative Examples 2 and 4, and both the increase in the resistance and the generation of discharge marks are suppressed in Examples.

The foregoing description of the exemplary embodiments of the present disclosure has been provided for the purposes of illustration and description. It is not intended to be exhaustive or to limit the disclosure to the precise forma disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

an intermediate transfer body which is a first endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less;

a first transfer component that first-transfers a toner image formed on a surface of an image carrier to a surface of the intermediate transfer body; and a second transfer component which has a second endless belt disposed so as to face the outer peripheral surface of the intermediate transfer body, which second-transfers the toner image transferred to the surface of the intermediate transfer body to a surface of a recording medium on the second endless belt, and in which the second endless belt includes a conductive layer that has

TABLE 2

| | | Example 1 | Example 2 | Example 3 | Example 4 | Comparative Example 1 | Comparative Example 2 | Comparative Example 3 | Comparative Example 4 | Reference Example 1 | Reference Example 2 |
|---|---|---|---|---|---|---|---|---|---|---|---|
| Intermediate transfer body | Intermediate transfer body | A | B | A | A | C | A | A | A | C | C |
| | Volume resistivity (LogΩ · cm) | 10.1 | 10.0 | 10.1 | 10.1 | 10.0 | 10.1 | 10.1 | 10.1 | 10.0 | 10.0 |
| | L(r) integrated value | 0.6 | 0.04 | 0.06 | 0.06 | 0.90 | 0.06 | 0.06 | 0.06 | 0.90 | 0.90 |
| Second transfer member | Second transfer member | A1 | A1 | A2 | A3 | A1 | B1 | B2 | C1 | B1 | B2 |
| | Number of domains (domains) | 50 | 50 | 45 | 30 | 50 | 100 | 18 | 12 | 100 | 18 |
| | Area ratio (%) | 96 | 96 | 95 | 90 | 96 | 99 | 80 | 84 | 99 | 80 |
| | Volume resistivity (LogΩ ·cm) | 10.0 | 10.0 | 11.0 | 12.5 | 10.0 | 8.5 | 13.0 | 11.0 | 8.5 | 13.0 |
| Evaluation | Evaluation of transferability | B | A | B | B | B | D | C | B | E | D |
| | Evaluation of Increase in resistance | A | A | A | A | A | D | A | D | D | A |
| | Evaluation of discharge mark | A | A | A | A | D | A | C | C | A | D |

a matrix containing an ionically conductive organic polymer material and domains formed by aggregates of an electronically conductive conductivity-imparting agent and having particle sizes of 100 nm or more and 3 μm or less, a number of the domains in a 10 μm×10 μm square of the conductive layer is 20 or more and 50 or less, and a common logarithm of a volume resistivity of the entire second endless belt is 10.0 Log Ω·cm or more and 12.5 Log Ω·cm or less:

$$L(r):=\sqrt{K(r)/\pi}-r \tag{1}$$

where r represents the interparticle distance, and K(r) represents a Ripley's K function K(r) represented by a formula (2) below:

$$K(r):=\frac{\sum_{i\neq j}^{N} 1(|X_i-X_j|\leq r)/s(|X_i-X_j|)}{\lambda^2} \tag{2}$$

where $1(|X_i-X_j|\leq r)$ represents an indicator function; $X_i$ and $X_j$ represent coordinates of a point i and a point j, respectively; $|X_i-X_j|$ represents a Euclidean distance between the coordinates $X_i$ and the coordinates $X_j$; r represents the interparticle distance; $s(|X_i-X_j|)$ represents an edge correction factor s(x) in the evaluation region, the edge correction factor s(x) being represented by a formula (3) below, where $x=|X_i-X_j|$; N represents a total number of particles in the evaluation region; and λ represents a number density of particles in the evaluation region:

$$s(x):=L_xL_y-\frac{x}{\pi}(2L_x+2L_y-x) \tag{3}$$

where $L_x$ and $L_y$ represent a length (μm) of a side of the evaluation region in an x-axis direction and a length (μm) of a side of the evaluation region in a y-axis direction, respectively; $x=|X_i-X_j|$; $X_i$ and $X_j$ represent coordinates of the point i and the point j, respectively; and $|X_i-X_j|$ represents the Euclidean distance between the coordinates $X_i$ and the coordinates $X_j$.

2. The transfer device according to claim 1, wherein the common logarithm of the volume resistivity of the entire second endless belt is 10.0 Log Ω·cm or more and 11.6 Log Ω·cm or less.

3. The transfer device according to claim 1, wherein the organic polymer material is a rubber material.

4. The transfer device according to claim 2, wherein the organic polymer material is a rubber material.

5. The transfer device according to claim 3, wherein the rubber material includes at least one selected from the group consisting of an epichlorohydrin rubber, a chloroprene rubber, and an acrylonitrile-butadiene copolymer rubber.

6. The transfer device according to claim 4, wherein the rubber material includes at least one selected from the group consisting of an epichlorohydrin rubber, a chloroprene rubber, and an acrylonitrile-butadiene copolymer rubber.

7. The transfer device according to claim 3, wherein the rubber material includes an epichlorohydrin rubber, a chloroprene rubber, an acrylonitrile-butadiene copolymer rubber, and an ethylene-propylene-diene terpolymer rubber.

8. The transfer device according to claim 4, wherein the rubber material includes an epichlorohydrin rubber, a chloroprene rubber, an acrylonitrile-butadiene copolymer rubber, and an ethylene-propylene-diene terpolymer rubber.

9. The transfer device according to claim 5, wherein the rubber material includes an epichlorohydrin rubber, a chloroprene rubber, an acrylonitrile-butadiene copolymer rubber, and an ethylene-propylene-diene terpolymer rubber.

10. The transfer device according to claim 6, wherein the rubber material includes an epichlorohydrin rubber, a chloroprene rubber, an acrylonitrile-butadiene copolymer rubber, and an ethylene-propylene-diene terpolymer rubber.

11. The transfer device according to claim 1, wherein the conductivity-imparting agent is carbon black.

12. The transfer device according to claim 2, wherein the conductivity-imparting agent is carbon black.

13. The transfer device according to claim 1, wherein the resin includes at least one selected from the group consisting of a polyimide resin, a polyamide-imide resin, an aromatic polyether ether ketone resin, a polyphenylene sulfide resin, and a polyetherimide resin.

14. The transfer device according to claim 2, wherein the resin includes at least one selected from the group consisting of a polyimide resin, a polyamide-imide resin, an aromatic polyether ether ketone resin, a polyphenylene sulfide resin, and a polyetherimide resin.

15. The transfer device according to claim 13, wherein the resin includes a polyimide resin.

16. The transfer device according to claim 1, wherein the conductive carbon particles have a number-average primary particle size of 10 nm or more and 20 nm or less.

17. The transfer device according to claim 16, wherein the conductive carbon particles have a number-average primary particle size of 10 nm or more and 15 nm or less.

18. The transfer device according to claim 1, wherein the conductive carbon particles are channel black.

19. The transfer device according to claim 1, wherein the conductive carbon particles have a number-average primary particle size that is 0.1 times or more and 1.0 time or less a number-average primary particle size of the electronically conductive conductivity-imparting agent.

20. An image forming apparatus comprising:

an image carrier, a charging device that charges a surface of the image carrier;

an electrostatic latent image forming device that forms an electrostatic latent image on the charged surface of the image carrier, a developing device that houses a developer containing a toner and that develops the electrostatic latent image formed on the surface of the image carrier by using the developer to form a toner image; and a transfer device that transfers the toner image to a surface of a recording medium, the transfer device being the transfer device according to claim 1.

* * * * *